US009557010B2

(12) United States Patent
Kim et al.

(10) Patent No.: US 9,557,010 B2
(45) Date of Patent: Jan. 31, 2017

(54) LIGHTING DEVICE

(71) Applicant: LG INNOTEK CO., LTD., Seoul (KR)

(72) Inventors: Ki Hyun Kim, Seoul (KR); Eun Hwa Kim, Seoul (KR); Bo Hee Kang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/052,609

(22) Filed: Feb. 24, 2016

(65) Prior Publication Data

US 2016/0169455 A1 Jun. 16, 2016

Related U.S. Application Data

(60) Continuation of application No. 14/812,843, filed on Jul. 29, 2015, now Pat. No. 9,303,822, which is a (Continued)

(30) Foreign Application Priority Data

Jan. 31, 2012 (KR) ..... 10-2012-0009699

(51) Int. Cl.
*F21V 29/00* (2015.01)
*F21K 99/00* (2016.01)
(Continued)

(52) U.S. Cl.
CPC ..... *F21K 9/1355* (2013.01); *F21K 9/23* (2016.08); *F21K 9/232* (2016.08); *F21K 9/64* (2016.08);
(Continued)

(58) Field of Classification Search
CPC ..... F21K 9/1355; F21K 9/23; F21K 9/232; F21K 9/64; F21V 5/04; F21V 3/02; F21V 3/0436;F21V 3/0463; F21V 3/0472; F21V 3/0481; F21V 7/0016
See application file for complete search history.

(56) References Cited

U.S. PATENT DOCUMENTS 6,220,722 B1 4/2001 Begemann
6,634,770 B2 10/2003 Cao
(Continued)

FOREIGN PATENT DOCUMENTS

CN 201568889 U 9/2010
CN 101865372 A 10/2010
(Continued)

OTHER PUBLICATIONS

Japanese Office Action Feb. 23, 2016 issued in Application No. 2014-528285 (with English translation).
(Continued)

*Primary Examiner* — Thomas M Sember
(74) *Attorney, Agent, or Firm* — KED & Associates, LLP

(57) ABSTRACT

A lighting device may be provided that includes: a heat sink; a member which has a polygonal pillar shape having at least three sides and is disposed on the heat sink, wherein the sides are inclined at a predetermined angle toward the center of the heat sink; and a light source which is disposed on at least one among the sides of the member, wherein the light source includes: a substrate; at least two light emitting devices which are symmetrically disposed on the substrate with respect to the center of the substrate; and at least two lens units which are disposed on the light emitting devices respectively, and consequently, it is possible to meet U.S. Energy Star and ANSI specifications, to remarkably improve rear light distribution characteristics and to remove a dark portion.

20 Claims, 13 Drawing Sheets

Related U.S. Application Data division of application No. 13/754,676, filed on Jan. 30, 2013, now Pat. No. 9,127,827.

(51) Int. Cl.

| | |
|---|---|
| ***F21V 5/04*** | (2006.01) |
| ***F21V 3/02*** | (2006.01) |
| ***F21V 29/77*** | (2015.01) |
| ***F21V 7/00*** | (2006.01) |
| *F21V 3/04* | (2006.01) |
| *F21V 23/00* | (2015.01) |
| *F21V 29/87* | (2015.01) |
| *F21V 29/89* | (2015.01) |
| *F21Y 101/00* | (2016.01) |

(52) U.S. Cl.

CPC ..... *F21V 3/02* (2013.01); *F21V 3/0436* (2013.01); *F21V 3/0472* (2013.01); *F21V 3/0481* (2013.01); *F21V 5/04* (2013.01); *F21V 7/0016* (2013.01); *F21V 29/773* (2015.01); *F21V 3/0463* (2013.01); *F21V 5/048* (2013.01); *F21V 23/009* (2013.01); *F21V 29/87* (2015.01); *F21V 29/89* (2015.01); *F21Y 2101/00* (2013.01); *F21Y 2107/30* (2016.08); *F21Y 2107/40* (2016.08); *F21Y 2115/10* (2016.08)

(56) References Cited

U.S. PATENT DOCUMENTS

| | | | |
|---|---|---|---|
| 6,719,446 | B2 | 4/2004 | Cao |
| 8,227,964 | B2 | 7/2012 | Choi et al. |
| 8,562,161 | B2 | 10/2013 | Tong et al. |
| 2003/0039119 | A1 | 2/2003 | Cao |
| 2008/0037255 | A1 | 2/2008 | Wang |
| 2008/0170396 | A1 | 7/2008 | Yuan et al. |
| 2008/0253125 | A1 | 10/2008 | Kang et al. |
| 2009/0175041 | A1 | 7/2009 | Yuen et al. |
| 2009/0195186 | A1 | 8/2009 | Guest et al. |
| 2009/0321767 | A1 | 12/2009 | Shih et al. |
| 2010/0103666 | A1 | 4/2010 | Chang et al. |
| 2010/0207502 | A1 | 8/2010 | Cao et al. |
| 2010/0264799 | A1 | 10/2010 | Liu et al. |
| 2011/0110096 | A1 | 5/2011 | Hong et al. |
| 2011/0156584 | A1 | 6/2011 | Kim |
| 2011/0169431 | A1 | 7/2011 | Li |
| 2011/0194288 | A1 | 8/2011 | Hsu |
| 2011/0215696 | A1 | 9/2011 | Tong et al. |
| 2011/0215699 | A1 | 9/2011 | Le et al. |
| 2011/0222280 | A1 | 9/2011 | Kim |
| 2011/0234078 | A1 | 9/2011 | Choi et al. |
| 2011/0248622 | A1 | 10/2011 | Wang |
| 2011/0273072 | A1 | 11/2011 | Oki |
| 2011/0291542 | A1 | 12/2011 | Lu et al. |
| 2011/0299269 | A1 | 12/2011 | Hata et al. |
| 2012/0049732 | A1 | 3/2012 | Chuang |
| 2012/0051069 | A1 | 3/2012 | Lim |
| 2012/0057327 | A1 | 3/2012 | Le et al. |
| 2012/0069545 | A1 | 3/2012 | Choi et al. |
| 2012/0268936 | A1 | 10/2012 | Pickard et al. |
| 2012/0275165 | A1 | 11/2012 | Choi et al. |
| 2012/0281405 | A1 | 11/2012 | Roth et al. |
| 2012/0287636 | A1 | 11/2012 | Chen |
| 2014/0247606 | A1 | 9/2014 | Chen et al. |

FOREIGN PATENT DOCUMENTS

| | | | |
|---|---|---|---|
| CN | 101922615 | A | 12/2010 |
| CN | 201688160 | U | 12/2010 |
| CN | 102147068 | A | 8/2011 |
| CN | 102270629 | A | 12/2011 |
| CN | 102384452 | A | 3/2012 |
| EP | 2 056 014 | A2 | 5/2009 |
| EP | 2 239 493 | A2 | 10/2010 |
| EP | 2 322 843 | A1 | 5/2011 |
| EP | 2 466 194 | A1 | 6/2012 |
| EP | 2 469 154 | A1 | 6/2012 |
| EP | 2 650 589 | A1 | 10/2013 |
| EP | 2 699 843 | A1 | 2/2014 |
| JP | 2007-012288 | A | 1/2007 |
| JP | 2007-048638 | A | 2/2007 |
| JP | 2010-055993 | A | 3/2010 |
| JP | 3163068 | U | 9/2010 |
| JP | 2010-287343 | A | 12/2010 |
| JP | 3164963 | U | 12/2010 |
| JP | 2011-096594 | A | 5/2011 |
| JP | 2011-159637 | A | 8/2011 |
| JP | 3171093 | U | 10/2011 |
| JP | 2011-228300 | A | 11/2011 |
| JP | 2012-099375 | A | 5/2012 |
| KR | 20-0447540 | Y1 | 2/2010 |
| KR | 10-2010-0037353 | A | 4/2010 |
| KR | 10-0955037 | B1 | 4/2010 |
| KR | 10-2010-0127447 | A | 12/2010 |
| KR | 10-2011-0050904 | A1 | 5/2011 |
| KR | 10-2011-0104782 | A | 9/2011 |
| KR | 10-2011-0113544 | A | 10/2011 |
| KR | 10-2011-0117090 | A | 10/2011 |
| KR | 10-1080700 | B1 | 11/2011 |
| KR | 10-2011-0133386 | A | 12/2011 |
| KR | 10-2011-0135600 | A | 12/2011 |
| KR | 10-2012-0060447 | A | 6/2012 |
| KR | 10-1264213 | B1 | 5/2013 |
| WO | WO 00/17569 | A1 | 3/2000 |
| WO | WO 2010/038982 | A2 | 4/2010 |
| WO | WO 2011/087023 | A1 | 7/2011 |
| WO | WO 2011/105030 | A1 | 9/2011 |

OTHER PUBLICATIONS

Korean Office Action dated Aug. 23, 2012 issued in Application No. 10-2011-0088970.

International Search Report dated Feb. 8, 2013 issued in Application No. PCT/KR2012/006995.

European Search Report dated Apr. 4, 2013 issued in Application No. 13 15 2311.

Korean Office Action dated Apr. 16, 2013 issued in Application No. 10-2011-0140134.

European Search Report dated Jul. 4, 2013 issued in Application No. 13 15 3490.

Korean Notice of Allowance dated Jul. 11, 2013 issued in Application No. 10-2011-0088970.

United States Notice of Allowance dated Nov. 13, 2013 issued in U.S. Appl. No. 13/738,605.

United States Office Action dated Mar. 7, 2014 issued in U.S. Appl. No. 13/583,752.

European Office Action dated Mar. 21, 2014 issued in Application No. 13 153 490.1.

U.S. Office Action dated Oct. 30, 2014 issued in U.S. Appl. No. 13/754,676.

Korean Search Report dated Feb. 4, 2015 issued in Application No. 10-2015-0012482.

Korean Search Report dated Feb. 6, 2015 issued in Application No. 10-2012-0055594.

European Search Report dated Feb. 26, 2015 issued in Application No. 12 828 129.2.

Chinese Office Action dated Apr. 23, 2015 issued in Application No. 201280042711.4 (English translation only).

U.S. Notice of Allowance dated Apr. 29, 2015 issued in U.S. Appl. No. 13/754,676.

Korean Office Action dated May 28, 2015 issued in Application No. 10-2015-0012482.

Korean Office Action dated Jun. 17, 2015 issued in Application No. 10-2012-0055594.

European Search Report dated Jul. 30, 2015 issued in Application No. 15165874.7.

Chinese Office Action dated Dec. 1, 2015 issued in Application No. 201310037557.8 (with English translation).

(56) References Cited

OTHER PUBLICATIONS

European Search Report dated Dec. 16, 2015 issued in Application No. 15178494.9.
United States Notice of Allowance dated Jan. 14, 2016 issued in U.S. Appl. No. 14/532,682.

Appendix B: Diagram of Omnidirectional Lamp Zones

LIGHTING DEVICE

CROSS-REFERENCE TO RELATED APPLICATIONS

This application is a Continuation of application Ser. No. 14/812,843, filed Jul. 29, 2015, which is a Continuation of application Ser. No. 13/754,676 filed Jan. 30, 2013 (now U.S. Pat. No. 9,127,827), which claims priority from Korean Application No. 10-2012-0009699 filed on Jan. 31, 2012, whose entire discloser are hereby incorporated by reference.

BACKGROUND

1. Field of the Invention

This embodiment relates to a lighting device capable of implementing rear light distribution.

2. Description of the Related Art

Here, related arts to the present invention will be provided and has not necessarily been to publicly known.

Nowadays, with the improvement of residential environment, indoor lighting is now being advanced from white lighting such as an existing fluorescent lamp, a halogen lamp or the like to luxurious interior lighting by representing indoor lighting colors, i.e., color temperatures in various ways. In particular, efforts are now being constantly made to representatively apply a light emitting diode (LED) light source device to the advanced interior lighting.

The LED has a small size and good efficiency and is capable of emitting light having an apparent color. Since the LED is a kind of a semiconductor device, the LED is less expected to be damaged, has excellent initial drive characteristic and impact-resistance, and is resistant to repetition like on/off lighting. For these reasons, the LED is now being widely used in various indicators and a variety of light sources. Moreover, R, G and B LEDs having ultra high luminance and high efficiency are now being developed respectively, and thus, a large-screen LED display using the LEDs is commercialized and widely used.

An angle at which light is emitted from a conventional LED lighting device is generally maintained from approximately 90° to 140°. Therefore, an interval at which a plurality of LEDs are disposed and mounted on a printed circuit board is set by the light emission angle. That is, the interval must be set such that the LEDs are densely disposed in order to prevent a dark zone from occurring due to the blocking of the light which is emitted from the LED and is incident on a light transmissive cover. Therefore, a fairly large number of the LEDs are required. Moreover, in order that the dark zone is removed by overlapping the light emitted from an LED with light emitted from another LED adjacent to the LED in a certain section, the light transmissive cover and the LED must be disposed at a large interval.

Accordingly, the conventional lighting device requires a large number of the LEDs and high manufacturing cost. The large interval between the light transmissive cover and the LED increases the thickness of the conventional lighting device, which makes the conventional lighting device become larger.

SUMMARY

An embodiment of the present invention provides a lighting device capable of implementing rear light distribution.

The embodiment provides a lighting device capable of diffusing light at a beam angle (Lambertian 120°) of from 165° to 180°.

The embodiment provides a lighting device capable of removing a dark portion at a draft angle (14° to 16°) of a light source.

The embodiment provides a new structured lighting device capable of meeting U.S. Energy Star and ANSI specifications.

The embodiment provides a lighting device capable of obtaining a rear light distribution design technology for standardization.

The embodiment provides a lighting device capable of implementing rear light distribution characteristics by using a primary lens (e. g., a beam angle 160°).

One embodiment is a lighting device including: a heat sink; a member which has a polygonal pillar shape having at least three sides and is disposed on the heat sink, wherein the sides are inclined at a predetermined angle toward the center of the heat sink; and a light source which is disposed on at least one among the sides of the member, wherein the light source includes: a substrate; at least two light emitting devices which are symmetrically disposed on the substrate with respect to the center of the substrate; and at least two lens units which are disposed on the light emitting devices respectively Another embodiment is a lighting device including: a heat sink; a member which has a polygonal pillar shape having at least three sides and is disposed on the heat sink, wherein the sides are inclined at a predetermined angle toward the center of the heat sink; a light source which is disposed on at least one among the sides of the member and includes a substrate and at least two light emitting devices which are symmetrically disposed on the substrate with respect to the center of the substrate; and a lens unit including a lens disposed on the light emitting device. The lens includes a cylindrical side and a curved surface formed on the cylindrical side. The heat sink includes a top surface and a side which is inclined at a predetermined inclination angle on the basis of an imaginary line parallel with the top surface.

BRIEF DESCRIPTION OF THE DRAWINGS

Arrangements and embodiments may be described in detail with reference to the following drawings in which like reference numerals refer to like elements and wherein:

(FIG. 16*a* shows the luminous intensity distribution of the conventional lighting device as viewed from the top thereof, FIG. 16*b* shows the luminous intensity distribution of the conventional lighting device as viewed from the front thereof, and FIG. 16*c* shows the luminous intensity distribution of the conventional lighting device as viewed from the side thereof at an angle of 45°); (FIG. 17*a* shows the luminous intensity distribution of the lighting device as viewed from the top thereof, FIG. 17*b* shows the luminous intensity distribution of the lighting device as viewed from the front thereof, and FIG. 17*c* shows the luminous intensity distribution of the lighting device as viewed from the side thereof at an angle of 45°).

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being cony or "under" another element, it may be directly on/under the element, and/or one or more intervening elements may also be present. When an element is referred to as being cony or 'under', 'under the element' as well as con the element' may be included based on the element.

An embodiment may be described in detail with reference to the accompanying drawings.

Embodiment of Lighting Device

Figure 1:
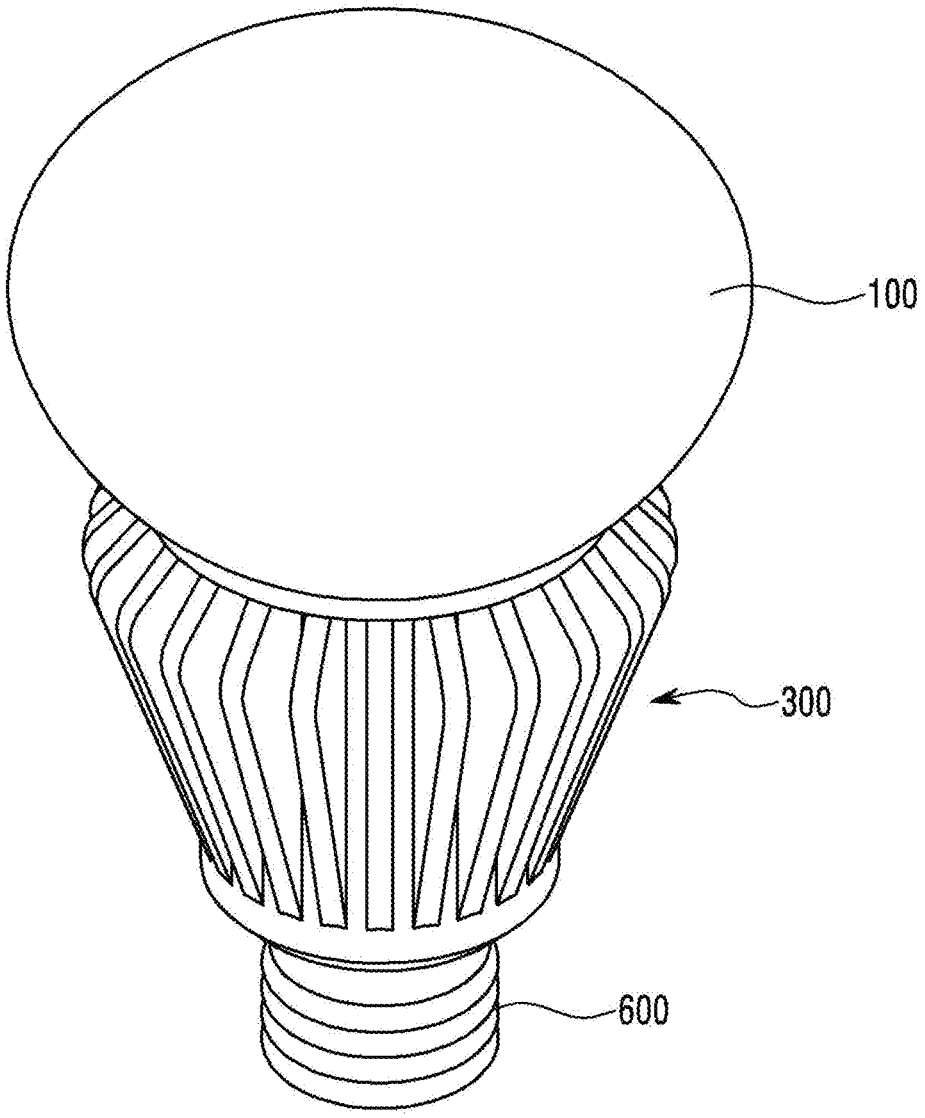
FIG. 1 is a perspective view of a lighting device according to an embodiment.
Figure 2:
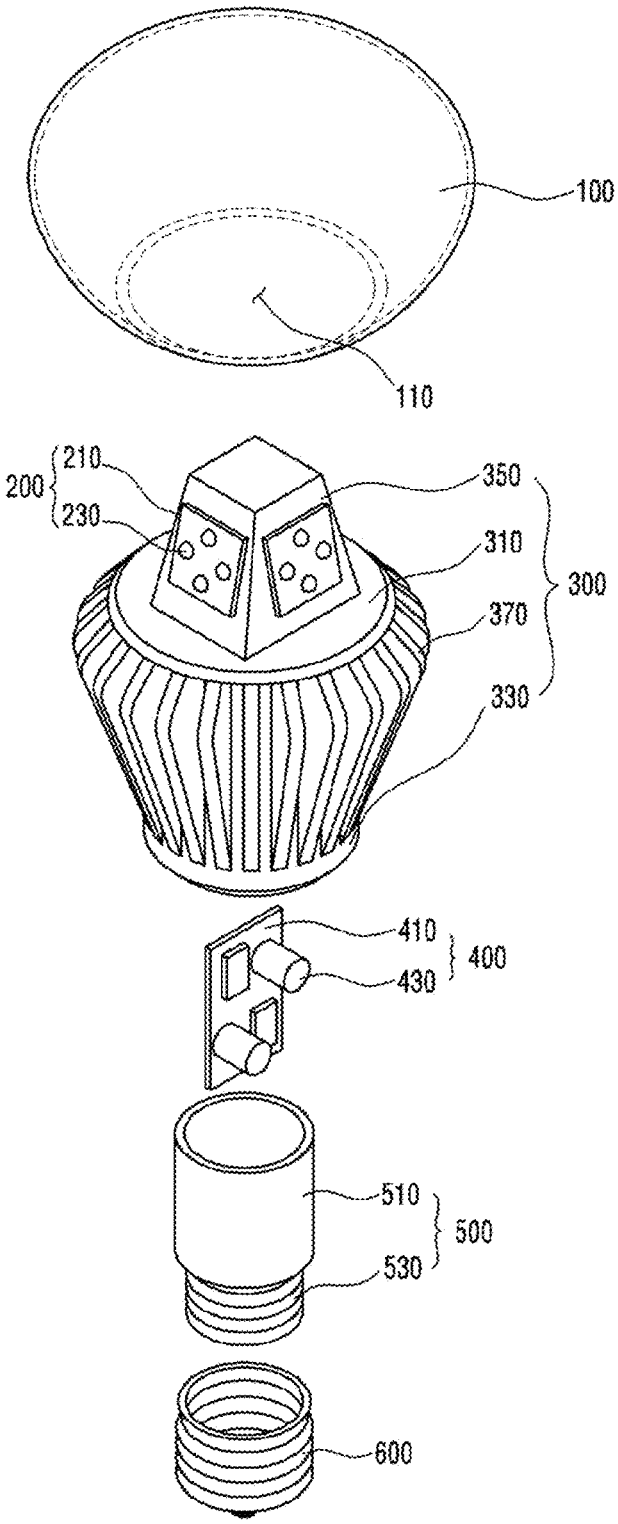
FIG. 2 is an exploded perspective view of the lighting device.
Figure 3:
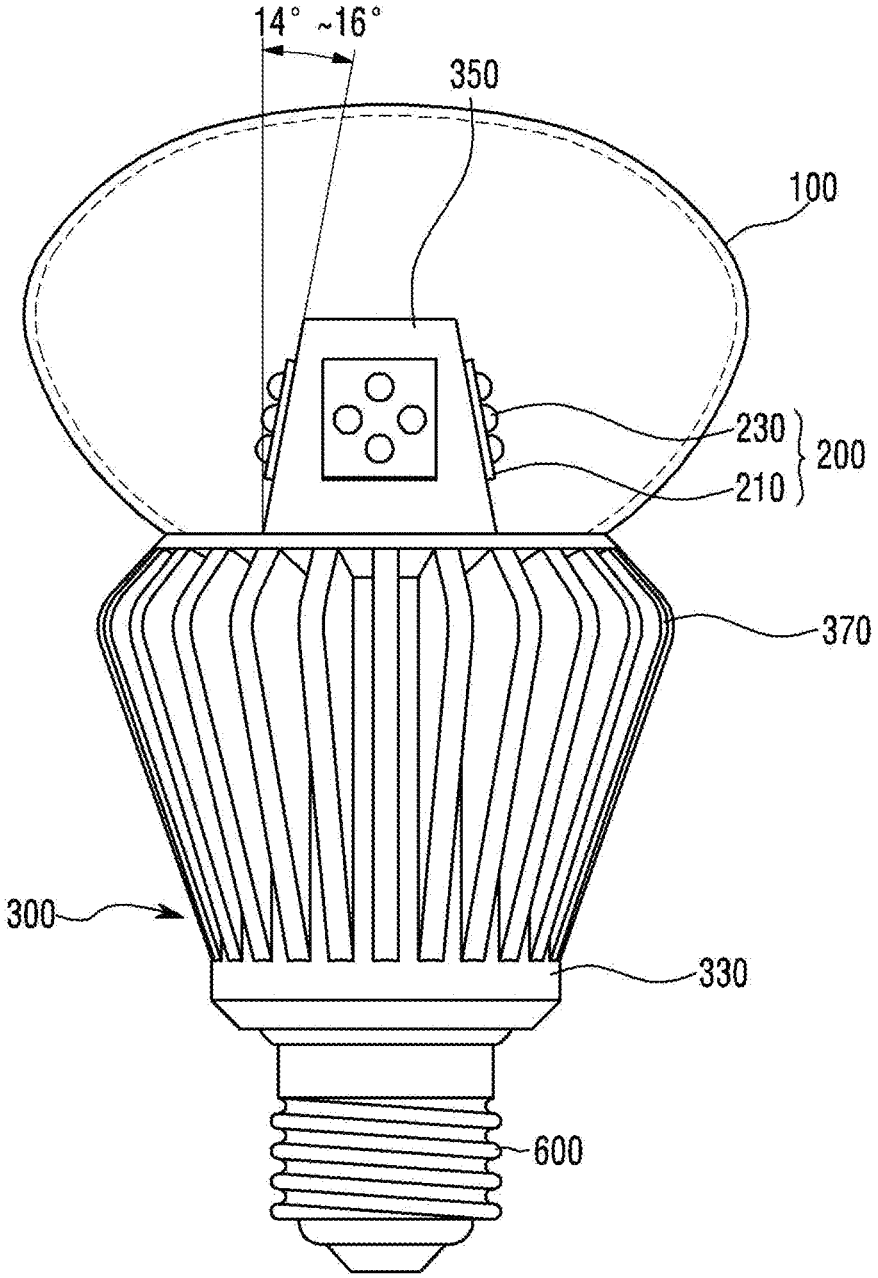
FIG. 3 is a front view of the lighting device.
Figure 4:
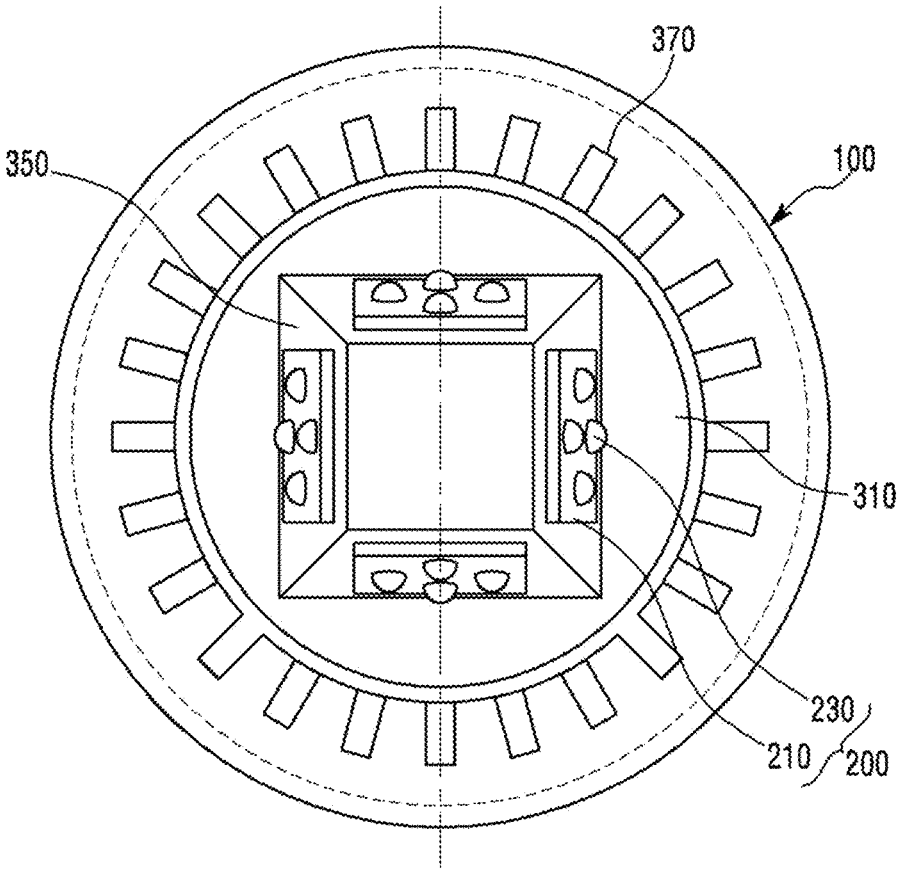
FIG. 4 is a plan view of the lighting device.

FIG. 1 is a perspective view of a lighting device according to an embodiment. FIG. 2 is an exploded perspective view of the lighting device. FIG. 3 is a front view of the lighting device. FIG. 4 is a plan view of the lighting device.

The lighting device according to the embodiment may include, as shown in FIGS. 1 to 4, a cover 100, a light source 200, a heat sink 300, a circuitry 400, an inner case 500 and a socket 600.

The cover 100 is disposed on the heat sink 300 and has an opening 110 formed in a lower portion thereof. The cover 100 has a bulb shape with an empty interior.

When the cover 100 is coupled to the heat sink 300, the light source 200 and a member 350 are inserted into the inside of the cover 100. Therefore, when the cover 100 is coupled to the heat sink 300, the light source 200 and the member 350 are surrounded by the cover 100.

Here, the cover 100 may be coupled to the heat sink 300 by using an adhesive or various methods, for example, rotary coupling, hook coupling and the like. In the rotary coupling method, the screw thread of the cover 100 is coupled to the screw groove of the heat sink 300. That is, the cover 100 and the heat sink 300 are coupled to each other by the rotation of the cover 100. In the hook coupling method, the cover 100 and the heat sink 300 are coupled to each other by inserting and fixing a protrusion of the cover 100 into the groove of the heat sink 300. Also, the cover 100 may include a plurality of projections (not shown). The heat sink 300 may include a plurality of recesses corresponding to a plurality of the projections.

A plurality of the projections are inserted into a plurality of the recesses of the heat sink 300 and have a shape suitable for being fastened to the recess. For example, a tip of the projection may have a trapezoidal shape for being fastened to the heat sink 300.

As such, the cover 100 may be disposed on the heat sink 300 and may have the opening 110 formed in the lower portion thereof. Also, the cover 100 may include an upper portion corresponding to the lower portion thereof, and a central portion between the lower portion and the upper portion. The diameter of the opening 110 of the lower portion may be equal to or less than that of the top surface of the heat sink 300. The diameter of the central portion may be larger than that of the top surface of the heat sink 300.

The cover 100 is optically coupled to the light source 200. In more detail, the cover 100 may diffuse, scatter or excite light emitted from a light emitting device (see reference number 220 of FIG. 6) of the light source 200. The cover 100 may include a reflective material disposed on at least a portion thereof, which reflects a part of the light and excites the other part of the light. Specifically, any one of the inner surface, outer surface, inner and outer surfaces and inside of the cover 100 may have at least one fluorescent material so as to excite the light emitted from the light source 200.

The inner surface of the cover 100 may be coated with an opalescent pigment. Here, the opalescent pigment may include a diffusing agent diffusing the light.

The roughness of the inner surface of the cover 100 may be larger than that of the outer surface of the cover 100. This intends to sufficiently scatter and diffuse the light emitted from the light source 200.

The cover 100 may be formed of glass or a resin material such as plastic, polypropylene (PP), polyethylene (PE), polycarbonate (PC) and the like. Here, the polycarbonate (PC) has excellent light resistance, thermal resistance and rigidity.

The cover 100 may be formed of a transparent material causing the light source 200 and the member 350 to be visible to the outside or may be formed of an opaque material causing the light source 200 and the member 350 not to be visible to the outside. The cover 100 may be formed by a blow molding process.

The cover 100 may include a reflective material reflecting at least a part of the light emitted from the light source 200 toward the heat sink 300. A corrosion process may be performed on the inner surface of the cover 100. Moreover, a predetermined pattern may be applied on the outer surface of the cover 100. Due to the mentioned characteristics, the light emitted from the light source 200 may be scattered. Therefore, it is possible to prevent a user from feeling glare.

The light source 200 may be disposed on the member 350 disposed on the heat sink 300. More specifically, the light source 200 may be disposed on at least one of sides of the member 350. Here, the member 350 may have a polygonal pillar shape having sides which are inclined at a predetermined angle.

For example, the member 350 may have a side which is inclined at an angle from 14° to 16° toward the center of the heat sink 300. The member 350 may have any one of a polygonal pillar shapes including a triangular pillar, a square pillar, a hexagonal pillar and an octagonal pillar or may have a conical pillar shape. As such, the light source disposed on the side of the member diffuses the light through the cover, thereby improving the performance of rear light distribution.

In the lighting device, at least two light sources 200 may be disposed on the side of the member 350. The embodiment shows that the member 350 has a square pillar shape and the light source 200 is disposed on four sides of the member 350 respectively. However, there is no limit to this. The light source 200 may be disposed on a portion of the side of the member 350. The configuration of the member 350 will be described later in detail.

The light source 200 includes a substrate 210, at least one light emitting device (see reference number 220 of FIG. 6), a lens unit 230 which is disposed on the light emitting device 220 of the substrate 210 and has a beam angle of from 165° to 180°. The light source 200 will be described in detail in the following FIGS. 5 to 10.

Referring to FIG. 2 continuously, the heat sink 300 is coupled to the cover 100 and radiates heat from the light source 200 to the outside. The heat sink 300 has a predetermined volume and includes a top surface 310 and a body 330. In other words, the heat sink 300 includes the top surface 310 and the body 330 including a side. The side includes a portion thereof which is connected to the top surface 310 and has a predetermined inclination. Here, the inclination of the portion may have a range more than 45° on the basis of an imaginary line parallel with the top surface 310.

The member 350 is disposed on the top surface 310 of the heat sink 300. The top surface 310 is coupled to the cover 100. Here, the top surface 310 may have a shape corresponding to the opening 110 of the cover 100.

A plurality of heat radiating fins 370 may be disposed on the outer circumferential surface of the body 330 of the heat sink 300. At least a portion of the heat radiating fins 370 may have a side having a predetermined inclination. Here, the inclination may have a range more than 45° on the basis of an imaginary line parallel with the top surface of the heat sink 300.

The heat radiation fin 370 may be formed extending outwardly from the outer surface of the heat sink 300 or may be coupled to the outer surface of the heat sink 300. The heat radiating fin 370 having the described structure is able to improve heat radiation efficiency by increasing the heat radiating area of the heat sink 300.

In the mean time, for another example, the heat sink 300 may not include the heat radiation fin 370.

The heat sink 300 may have a receiver (not shown) receiving the circuitry 400 and the inner case 500.

The member 350 disposed on the top surface 310 of the heat sink 300 may be integrally formed with the top surface 310 of the heat sink 300 or may be coupled to the top surface 310 of the heat sink 300.

The member 350 may have a polygonal pillar shape or a conical pillar shape, each of which has a side which is inclined at a predetermined angle (e.g., 14° to) 16°. For example, the member 350 may have a square pillar shape. The square pillar-shaped member 350 has a top surface, a bottom surface and four sides. For another example, the member 350 may have a cylindrical pillar shape or an elliptical pillar shape as well as the polygonal pillar shape. When the member 350 has the cylindrical pillar shape or the elliptical pillar shape, the substrate 210 of the light source 200 may be a flexible substrate.

The light source 200 may be disposed on the side of the member 350. That is, the light source 200 may be disposed on all or some of the four sides. Also, at least two light sources 200 may be disposed on the side of the member 350. The embodiment shows that the light source 200 is disposed on all of the four sides.

The embodiment shows that the member 350 has a square pillar shape which has four sides inclined at a predetermined angle (e.g., 14° to 16°) toward the center of the heat sink. The light source 200 is disposed on the four sides respectively, thereby removing a dark portion at a draft angle of the light source 200. Further, a primary lens having a beam angle of from 165° to 180° is disposed on the light emitting device 220 of the light source 200, thereby improving rear light distribution characteristics.

The material of the member 350 may have thermal conductivity. This intends to rapidly radiate outwardly the heat generated from the light source 200. The material of the member 350 may include, for example, Al, Ni, Cu, Mg, Ag, Sn and the like and an alloy including these metallic materials. The member 350 may be also formed of thermally conductive plastic. The thermally conductive plastic is lighter than a metallic material and has a unidirectional thermal conductivity.

Referring to FIG. 2 continuously, the circuitry 400 receives external electric power, and then converts the received electric power in accordance with the light source 200. The circuitry 400 supplies the converted electric power to the light source 200.

The circuitry 400 is received within the heat sink 300. Specifically, the circuitry 400 is received in the inner case 500, and then is received, together with the inner case 500, in the receiver (not shown) formed in a lower inside of the heat sink 300.

The circuitry 400 may include a circuit board 410 and a plurality of parts 430 mounted on the circuit board 410. Here, the circuit board 410 may have a quadrangular plate shape. However, the circuit board 410 may have various shapes without being limited to this. For example, the circuit board 410 may have a circular plate shape, an elliptical plate shape or a polygonal plate shape. The circuit board 410 may be formed by printing a circuit pattern on an insulator.

The circuit board 410 is electrically connected to the substrate 210 of the light source 200. The circuit board 410 may be electrically connected to the substrate 210 by using a wire. That is, the wire is disposed within the heat sink 300 and may connect the circuit board 410 with the substrate 210.

The plurality of the parts 430 may include, for example, a DC converter converting AC power supply supplied by an external power supply into DC power supply, a driving chip controlling the driving of the light source 200, and an electrostatic discharge (ESD) protective device for protecting the light source 200.

Also, the inner case 500 receives the circuitry 400 thereinside. The inner case 500 may have a receiver 510 for receiving the circuitry 400. The receiver 510 may have a cylindrical shape. The shape of the receiver 510 may be changed according to the shape of the receiver (not shown) of the heat sink 300.

The inner case 500 is received within the heat sink 300. More specifically, the receiver 510 of the inner case 500 is received in the receiver (not shown) formed in the bottom surface (not shown) of the heat sink 300.

The inner case 500 is coupled to the socket 600. The inner case 500 may include a connection portion 530 which is coupled to the socket 600. The connection portion 530 may have a screw thread corresponding to a screw groove of the socket 600.

The inner case 500 may consist of a nonconductor. Therefore, the inner case 500 prevents electrical short-cut between the circuitry 400 and the heat sink 300. The inner case 500 may be made of a plastic or resin material.

Lastly, the socket 600 is coupled to the inner case 500. More specifically, the socket 600 is coupled to the connection portion 530 of the inner case 500.

The socket 600 may have the same structure as that of a conventional incandescent bulb. The circuitry 400 is electrically connected to the socket 600. Here, the circuitry 400 may be electrically connected to the socket 600 by using a wire. Therefore, when external electric power is applied to the socket 600, the external electric power may be supplied to the circuitry 400 through the socket 600, and then the electric power converted by the circuitry 400 is supplied to the light source 200. The socket 600 may have a screw groove corresponding to the screw thread of the connection portion 530.

As described above, the lighting device according to the embodiment is capable of meeting U.S. Energy Star and ANSI specifications and of remarkably improving rear light distribution characteristics and removing the dark portion by disposing the member 350 of which the side is inclined at a predetermined angle (14° to) 16° on the heat sink 300, by disposing the light source 200 on the side of the member 350, and by disposing the lens unit 230 having a beam angle of from 165° to 180° on the light emitting device 220 of the light source 200.

A Configuration Example of Light Source

Figure 5:
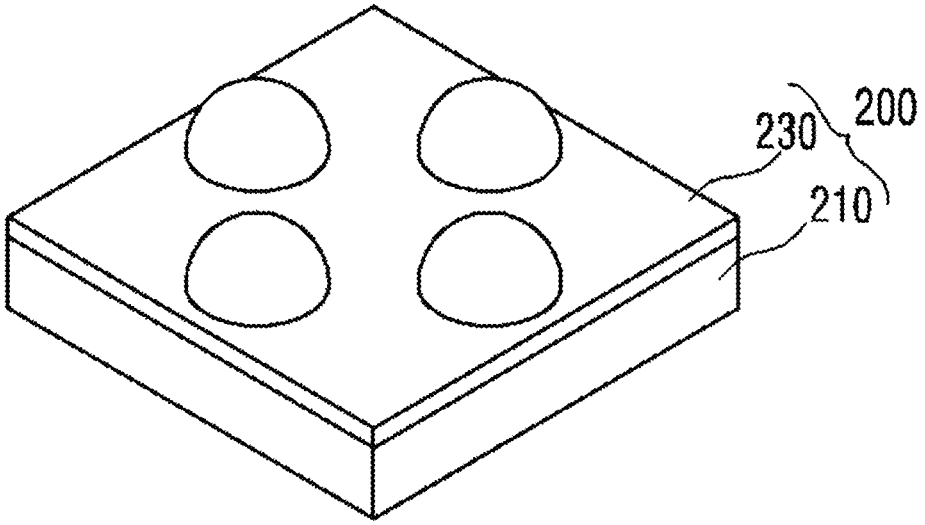
FIG. 5 is a perspective view of a light source.
Figure 6:
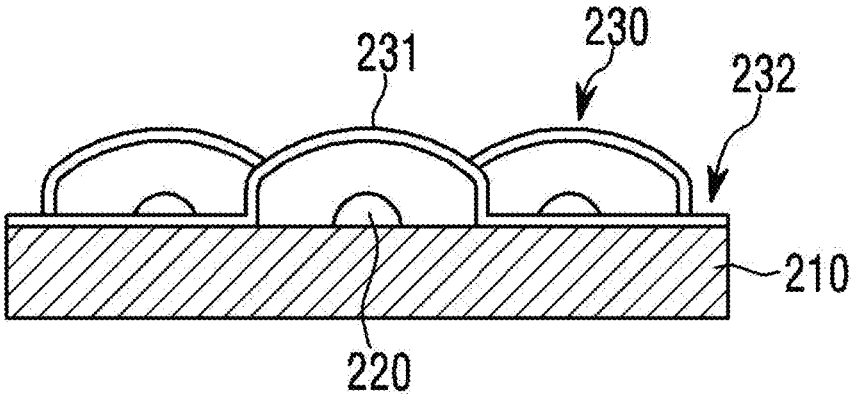
FIG. 6 is a side view of the light source.
Figure 7:
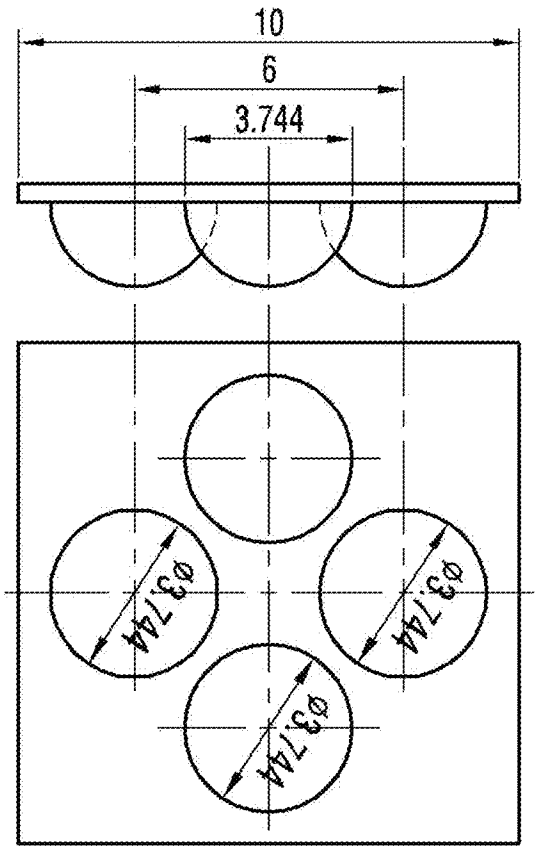
FIG. 7 is a view showing an example of measured values of a lens.

FIG. 5 is a perspective view of a light source. FIG. 6 is a side view of the light source. FIG. 7 is a view showing an example of measured values of a lens.

As shown in FIGS. 5 and 6, the light source 200 includes the substrate 210 and at least one light emitting device 220 disposed on the substrate 210. The drawing shows that four light emitting devices 220 are symmetrically disposed on one substrate 210. More specifically, the four light emitting devices 220 are symmetrically disposed on the substrate 210 with respect to the center of the substrate 210.

The light source 200 may further include the lens unit 230 disposed on the light emitting device 220 of the substrate 210. Here, the lens unit 230 may have a beam angle of from 165° to 180° and may be composed of an aspheric lens 231.

As shown in FIG. 6, the lens unit 230 is composed of the aspheric lenses 231 disposed on the light emitting device 220 respectively and a bottom surface 232 which is integrally formed with the aspheric lenses 231 and is disposed on the substrate 210. Here, the aspheric lens 231 has a cylindrical side formed vertically from the bottom surface 232 and has a hemispherical curved surface formed on the cylindrical side. The lens 231 may have any one selected from the group consisting of a convex shape, a hemispherical shape and a spherical shape. The lens 231 and the bottom surface 232 may be formed of an epoxy resin, a silicone resin, a urethane resin or a compound of them.

The lens 231 having the described configuration increases an orientation angle of the light emitted from the light emitting device 220, and thus improves the uniformity of a linear light source of the lighting device.

Meanwhile, the lens unit 230 may have optimized data as follows.

Referring to FIG. 7, the lens 231 may have a circular shape. A rear surface of the lens 231 may be aspheric. It may be designed that a diameter of the lens 231 is 3.744 mm, a distance between the centers of the two lenses 231 is 6 mm, a size of the bottom surface 232 is 10 mm, and a thickness of the lens unit 230 is 0.1 mm. Here, the diameter of the upper portion of the side of the lens 231 may be designed to be larger or less than that of the lens 231 in accordance with the height of the side.

Also, a reflective layer (not shown) may be formed on the bottom surface 232 of the lens unit 230. Here, the reflective layer may be formed of at least any one selected from the group consisting of metallic materials including Al, Cu, Pt, Ag, Ti, Cr, Au and Ni by deposition, sputtering, plating, printing or the like methods in the form of a single or composite layer.

The substrate 210 disposed under the lens unit 230 has a quadrangular plate shape. However, the lens unit 230 may have various shapes, for example, a circular shape, a polygonal shape and the like without being limited to the quadrangular plate shape.

The substrate 210 may be formed, for example, to have a size of 10×10×1.7 mm. Here, a chip size of the light emitting device 220 may have a size of 1.3×1.3×0.1 mm.

The substrate 210 may be formed by printing a circuit pattern on an insulator. For example, the substrate 210 may include a common printed circuit board (PCB), a metal core PCB, a flexible PCB, a ceramic PCB and the like. Also, the substrate 210 may include a chips on board (COB) allowing an LED chip to be directly bonded to a printed circuit board. The substrate 210 may be formed of a material capable of efficiently reflecting light. The surface of the substrate 210 may have a color (for example, white, silver and the like) capable of efficiently reflecting light. The surface of the substrate 210 may be formed of a material capable of efficiently reflecting light. The surface of the substrate 210 may be coated with a color capable of efficiently reflecting light (for example, white, silver and the like). For example, the surface of the substrate 210 may have a reflectance greater than 78% with respect to light reflected by the surface of the substrate 210.

Referring to FIG. 2, the substrate 210 is electrically connected to the circuitry 400 received in the heat sink 300. The substrate 210 may be connected to the circuitry 400 by means of a wire (not shown). The wire passes through the heat sink 300 and electrically connects the substrate 210 with the circuitry 400.

The light emitting device 220 may be a light emitting diode chip emitting red, green and blue light or may be a light emitting diode chip emitting UV. Here, the light emitting diode chip may have a lateral type or vertical type and may emit blue, red, yellow or green light.

The light emitting device 220 may have a fluorescent material. The fluorescent material may include at least any one selected from the group consisting of a garnet material (YAG, TAG), a silicate material, a nitride material and an oxynitride material. Otherwise, the fluorescent material may include at least any one selected from the group consisting of a yellow fluorescent material, a green fluorescent material and a red fluorescent material.

In the embodiment, the light emitting device 220 has a size of 1.3×1.3×0.1 mm. An LED chip including the blue LED and the yellow fluorescent material is used as the light emitting device 220. Here, the scattering of the LED chip is greater than 92% and Lambertian larger than 120° can be obtained.

Simulation Result of Lens

Figure 8:
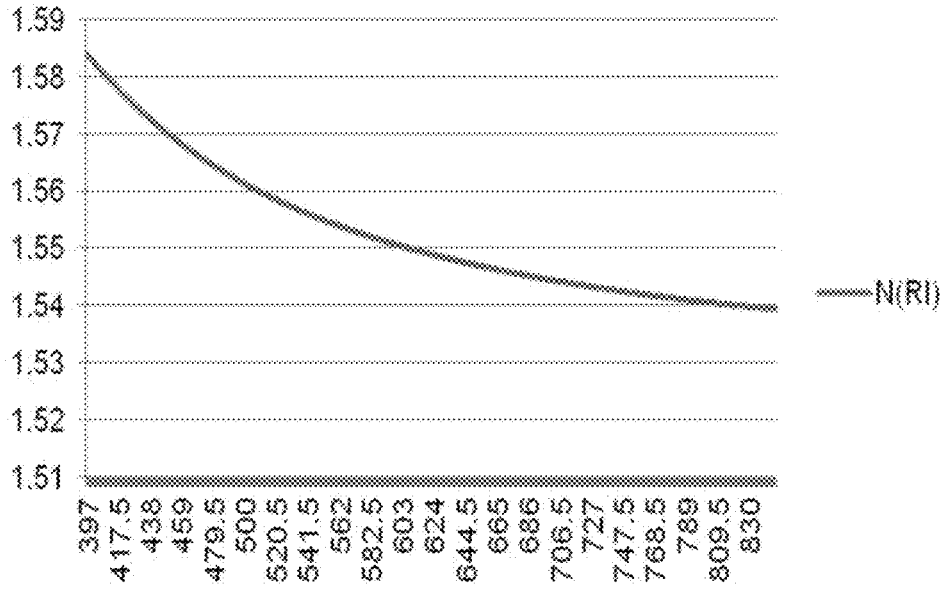
FIG. 8 is a graph showing a relation between a wavelength of the lens and rendering index (RI) of the lens.
Figure 9:
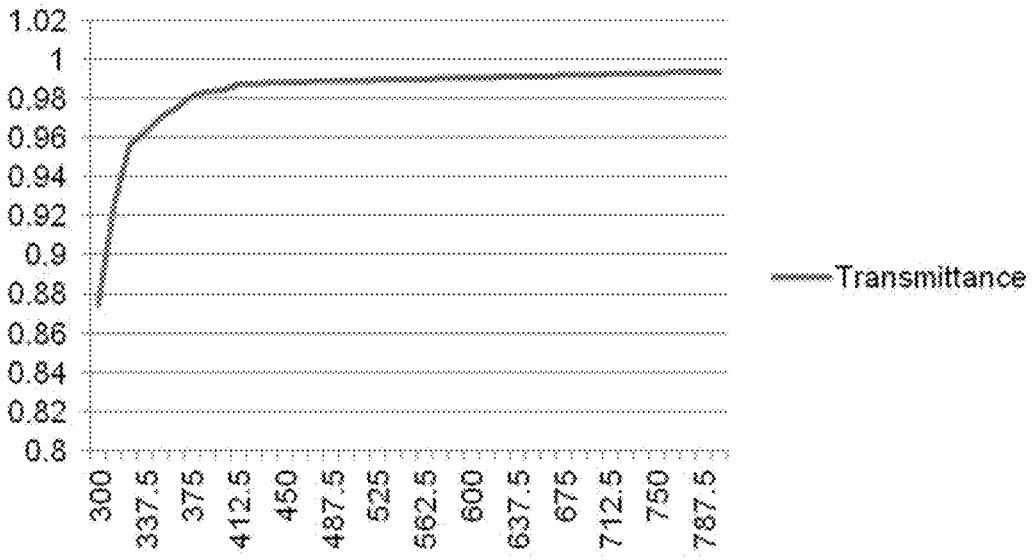
FIG. 9 is a graph showing a relation between a wavelength of the lens and transmittance of the lens.
Figure 10:
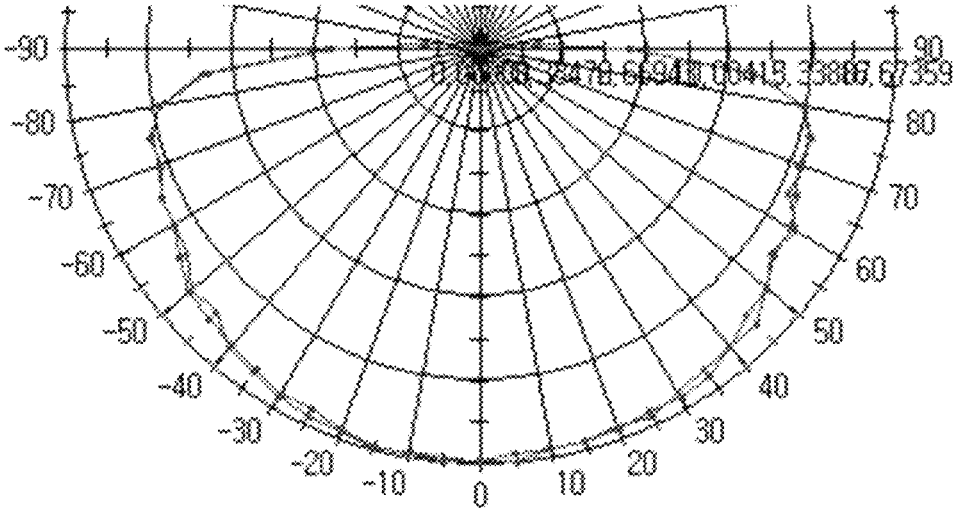
FIG. 10 is a color coordinate showing a beam angle of the lens and light efficiency of the lens.

FIG. 8 is a graph showing a relation between a wavelength of the lens and rendering index (RI) of the lens. FIG. 9 is a graph showing a relation between a wavelength of the lens and transmittance of the lens. FIG. 10 is a color coordinate showing a beam angle of the lens and light efficiency of the lens.

First, referring to FIG. 8, regarding the lens unit 230 according to the embodiment, the rendering index is decreased with the increase of the wavelength. Here, the horizontal axis of the graph represents the wavelength, and the vertical axis represents the rendering index (RI).

As shown in the graph of FIG. 9, regarding the lens unit 230, the transmittance is rapidly increased within a wavelength interval from 300 to 412.5 and then is maintained almost constant in the wavelength range greater than 412.5. Here, the horizontal axis of the graph represents the wavelength, and the vertical axis represents the transmittance.

As shown in the color coordinate of FIG. 10, it is revealed through the experiment that the lens unit 230 has a beam angle of from 165° to 180° and light efficiency higher than 90%.

U.S. Energy Star and ANSI Specifications

Figure 11:
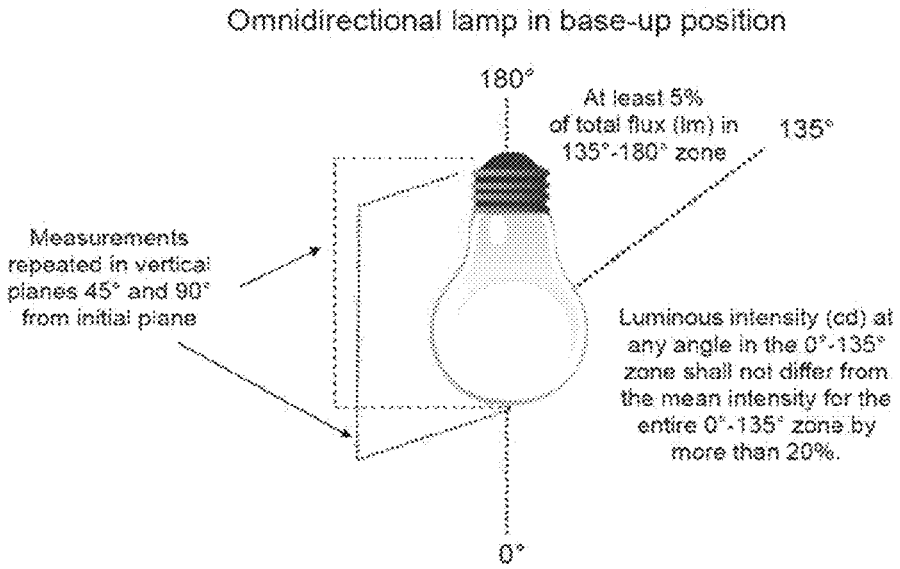
FIG. 11 is a view for describing luminous intensity distribution requirements of an omni-directional lamp in U.S. Energy Star.
Figure 12:
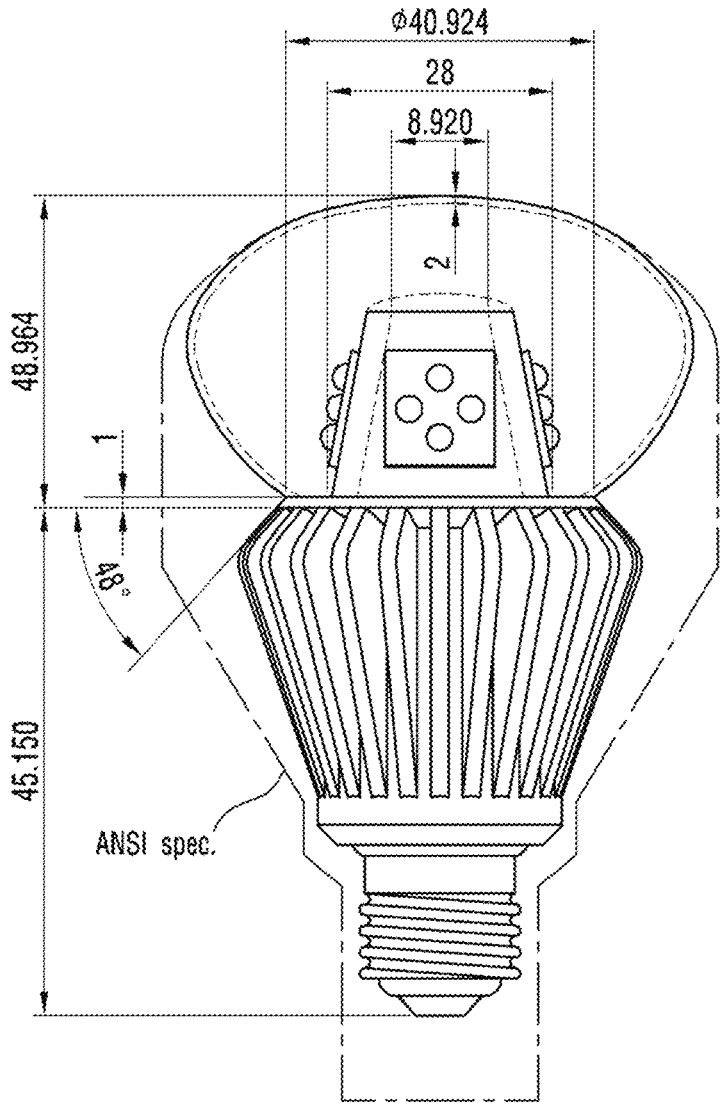
FIGS. 12 and 13 are views showing measured values of the lighting device of the embodiment, which meets ANSI specifications.
Figure 13:
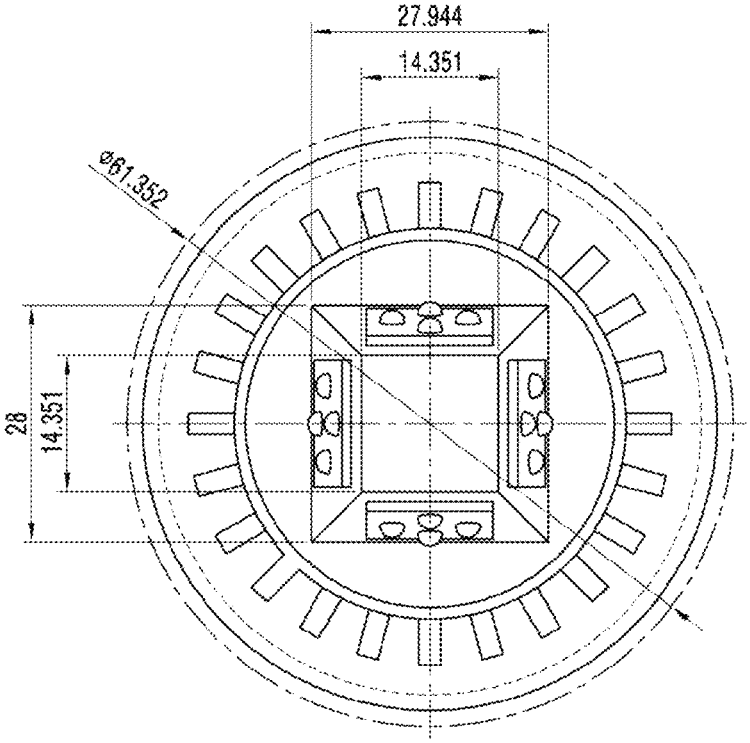

FIG. 11 is a view for describing luminous intensity distribution requirements of an omni-directional lamp in U.S. Energy Star. FIGS. 12 and 13 are views showing measured values of the lighting device of the embodiment, which meets ANSI specifications.

American National Standards Institute (ANSI) specifications have previously specified norms or standards for U.S. industrial products. ANSI specifications also provide standards for products like the lighting device of the embodiment.

For the purpose of meeting ANSI specifications, the lighting device according to the embodiment may be designed such that a ratio of the overall height of the lighting device, the height of the cover 100, the diameter of the cover 100, the diameter of the lower portion of the cover 100, the size of the lower portion of the member 350, the size of the upper portion of the member 350 and the thickness of the cover 100 is 46.5~47.5:24~25:30~31:20~21:13.5~14.5:6.6~7.5:1.

For example, referring to FIGS. 12 and 13, the lighting device according to the embodiment may be designed such that the overall height of the lighting device is 94.114 mm, the height of the cover 100 is 48.964 mm, the diameter of the cover 100 is 61.352 mm, the diameter of the lower portion of the cover 100 is 40.924 mm, the size of the lower portion of the member 350 is 28 mm, the size of the upper portion of the member 350 is 14.351 mm and the thickness of the cover 100 is 2 mm. Here, areas marked with an alternated long and short dash line in FIGS. 12 and 13 represent the sizes based on the ANSI specifications. Therefore, it can be seen that the lighting device according to the embodiment meets the ANSI specifications.

U.S. Energy Star stipulates that a lighting device or a lighting apparatus should have a predetermined luminous intensity distribution. FIG. 11 shows luminous intensity distribution requirements of an omni-directional lamp in U.S. Energy Star.

Particularly, referring to the Energy Star shown in FIG. 11, the Energy Star includes a requirement that at least 5% of the total flux (Im) of a lighting device should be emitted between 135° and 180° of the lighting device.

Through the following simulation result, it can be found that the lighting device according to the embodiment is able to meet the Energy Star shown in FIG. 11, and in particular, to meet the requirement that at least 5% of the total flux (Im) of the lighting device should be emitted between 135° and 180° of the lighting device.

Simulation Result

Figure 14:
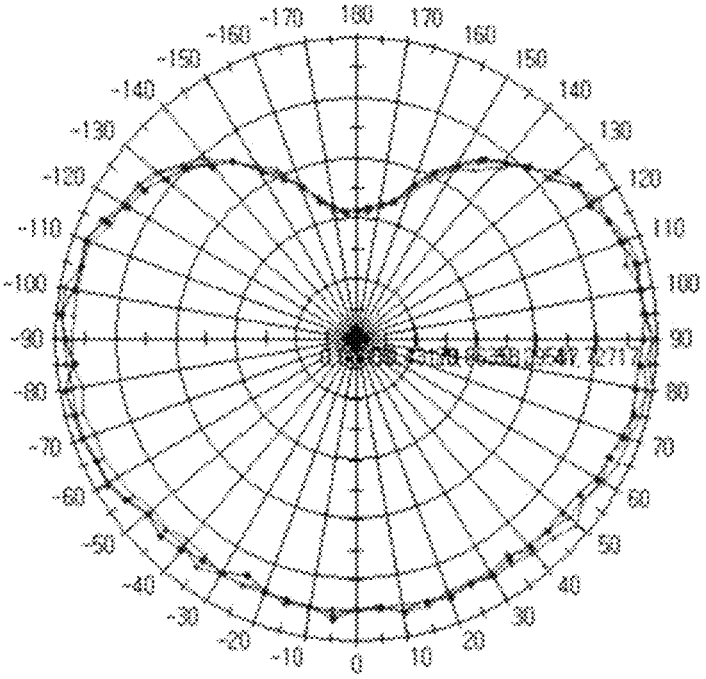
FIG. 14 is a view showing a color coordinate of a conventional lighting device.
Figure 15:
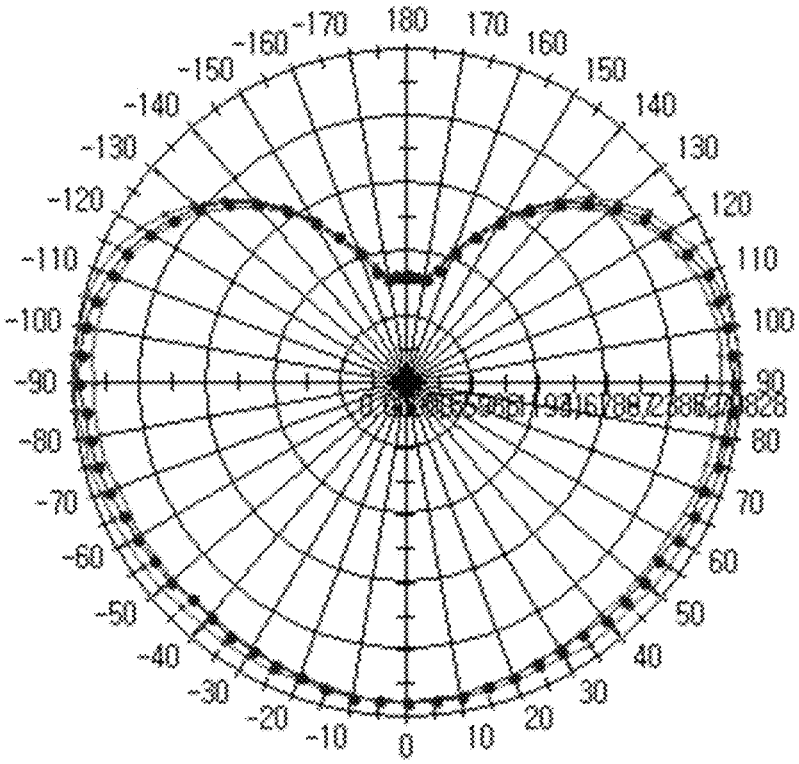
FIG. 15 is a view showing a color coordinate of the lighting device according to the embodiment.

FIG. 14 is a view showing a color coordinate of a conventional lighting device. FIG. 15 is a view showing a color coordinate of the lighting device according to the embodiment.

As shown in the color coordinate of FIG. 14, regarding the conventional lighting device, it is disclosed that maximum luminous intensity/minimum luminous intensity is 1.000/0.800 between 0° and 135° and an average luminous intensity is 0.917 between 0° and 135°. It is also disclosed that maximum luminous intensity deviation/minimum luminous intensity deviation is 8.3%/11.7% and a Flux ratio between 135° and 180° is 10/8%.

In comparison with the conventional lighting device, regarding the lighting device according to the embodiment as shown in the color coordinate of FIG. 15, it is disclosed that maximum luminous intensity/minimum luminous intensity is 1.000/0.761 between 0° and 135° and an average luminous intensity is 0.951 between 0° and 135°. It is also disclosed that maximum luminous intensity deviation/minimum luminous intensity deviation is 5.0%/19.0% and a Flux ratio between 135° and 180° is 13.5%.

Through the color coordinate result, it can be appreciated that the Flux ratio between 135° and 180° of the lighting device according to the embodiment is increased as compared with that of the conventional lighting device.

Figure 16A:
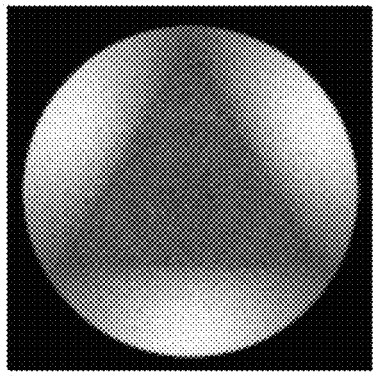
FIGS. 16*a*-16*c* show simulation results of the luminous intensity distribution of the conventional lighting device.
Figure 16B:
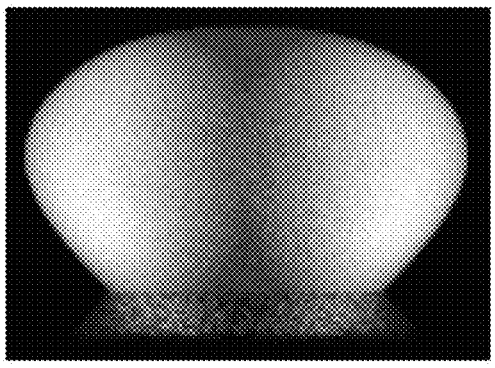
Figure 16C:
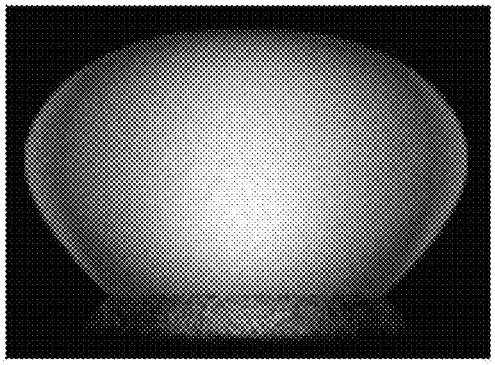

FIG. 16 shows a simulation result of the luminous intensity distribution of the conventional lighting device. FIG. 16*a* shows the luminous intensity distribution of the conventional lighting device as viewed from the top thereof. FIG. 16*b* shows the luminous intensity distribution of the conventional lighting device as viewed from the front thereof. FIG. 16*c* shows the luminous intensity distribution of the conventional lighting device as viewed from the side thereof at an angle of 45°.

Figure 17A:
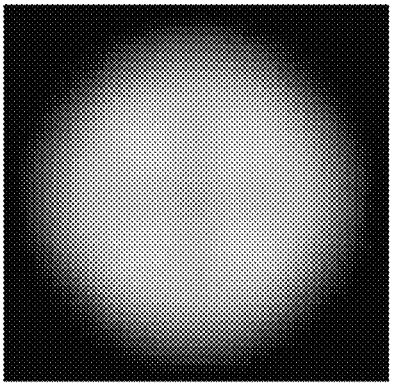
FIGS. 17*a*-17*c* show simulation results of the luminous intensity distribution of the lighting device according to the embodiment.
Figure 17B:
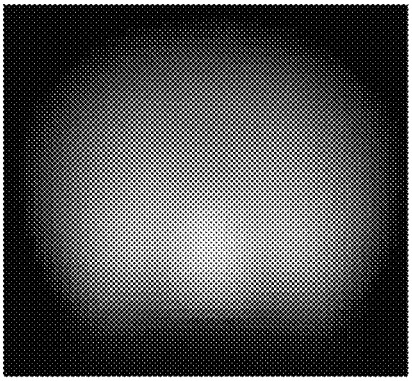
Figure 17C:
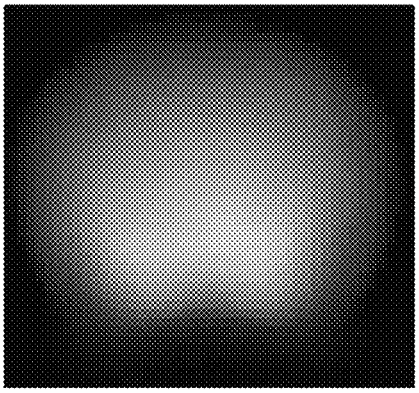

FIG. 17 shows a simulation result of the luminous intensity distribution of the lighting device according to the embodiment. FIG. 17*a* shows the luminous intensity distribution of the lighting device as viewed from the top thereof. FIG. 17*b* shows the luminous intensity distribution of the lighting device as viewed from the front thereof. FIG. 17*c* shows the luminous intensity distribution of the lighting device as viewed from the side thereof at an angle of 45°.

According to the simulation results of FIGS. 16 and 17, regarding the conventional lighting device, it is disclosed that maximum luminance/minimum luminance is 10.0%. Also, regarding the lighting device according to the embodiment, it is disclosed that maximum luminance/minimum luminance is 66.1%. Through this result, it can be appreciated that the maximum luminance/minimum luminance of the lighting device according to the embodiment is increased more than 56% as compared with that of the conventional lighting device.

Through a comparison of the simulation results of FIGS. 16 and 17, it is found that a dark portion occurs in the central portion of the conventional lighting device. In comparison with the conventional lighting device, it is found that no dark portion occurs in the central portion of the lighting device according to the embodiment and luminous intensity of the lighting device according to the embodiment is wholly uniformly distributed.

Therefore, the lighting device according to the embodiment shows that the rear light distribution characteristics required by the U.S. Energy Star is remarkably improved. Also, it can be seen through the simulation result that the existing dark portion is greatly reduced. The following table shows the simulation result (standardization) of the embodiment.

| Spec[cd] | Degree 0° | 45° | 90° | | |
|---|---|---|---|---|---|
| average luminous intensity between 0° and 135° | 0.952 | 0.947 | 0.957 | | |
| average luminous intensity + average luminous intensity of 20% | 1.142 | 1.137 | 1.148 | | |
| average luminous intensity − average luminous intensity of 20% | 0.762 | 0.758 | 0.765 | | |
| maximum luminous intensity between 0° and 135° | 1 (OK) | 1 (OK) | 1 (OK) | flux Rate between 135° and 180° (5% ↑ of Total flux) | 13.5% (OK) |
| minimum luminous intensity between 0° and 135° | 0.771 (OK) | 0.775 (OK) | 0.780 (OK) | Top Luminance (Min/Max) | 66.0% (OK) |

The through the simulation result of the embodiment, it is found that when the conditions such as the shape of the member 350, the location of the light source 200, the draft angle and the like are met, the U.S. Energy Star and the ANSI specifications are met.

In the lighting device according to the embodiment configured as such, the member of which the side is inclined at a predetermined angle is disposed on the heat sink in such a manner as to meet U.S. Energy Star and ANSI specifications, the light source is disposed on the side of the member, and the lens is disposed on the light emitting device of the light source, so that the technical problems of the present invention can be overcome.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a cover including an opening formed in a lower portion with an empty interior;

a heat sink including a body and a member, the body including a top surface, an outer circumferential surface and a plurality of fins disposed on the outer circumferential surface, the member extended from the top surface toward the cover, the member having a polygonal pillar shape with at least three sides; and a light source disposed on at least one among the sides of the member, the light source including a substrate, a plurality of light emitting devices disposed on the substrate and a lens unit disposed on the light emitting devices, the lens unit covering the light emitting devices, a shape of a bottom surface of the lens unit corresponding to a top surface of the substrate, wherein an entire portion of the plurality of fins are arranged under the top surface of the heat sink, wherein the fin includes a first point having a maximum height from the outer circumferential surface of the heat sink, and a second point nearest the top surface of the heat sink, wherein an angle between an imaginary line passing through the first point and the second point, and the top surface of the heat sink is less than 135 degrees, and wherein a height of the member is greater than half a height of the cover on the basis of the top surface of the heat sink.

2. The lighting device of claim 1, wherein a width horizontally measured between an outermost point of the fin and an innermost point of the fin contacting the body increases as the distance between the outermost point and the top surface increases until the outer most point reaches the first point, and wherein the width decreases as the distance between the outermost point and the first point increases until the outermost point converges to the innermost point.

3. The lighting device of claim 1, wherein the member extends from the top surface of the heat sink into the empty interior of the cover in a first direction, which is perpendicular to the top surface, and wherein the sides comprises a first side and a second side, which are opposing sides separated from each other by a prescribed distance in a second direction perpendicular to the first direction, wherein the prescribed distance is 35% to 68% of the prescribed diameter.

4. The lighting device of claim 3, wherein the heat sink includes a receiver formed in a lower inside to receive a circuitry, the lighting device further comprises a case comprising a non-conductive material to receive the circuitry.

5. The lighting device of claim 4, wherein the light emitting device is an LED chip or a UV LED chip, and wherein the light emitting devices are symmetrically disposed on the substrate of the light source with respect to a center of the substrate of the light source.

6. The lighting device of claim 4, wherein the substrate of the light source includes a top surface having a material capable of reflecting the light emitted from the light source.

7. The lighting device of claim 4, wherein the lens unit fully covers the light emitting devices.

8. The lighting device of claim 4, wherein the member is formed of a metallic material including Al, Ni, Cu, Mg, Ag and Sn or is formed of an alloy of these metallic materials.

9. The lighting device of claim 4, wherein the member is formed of a thermally conductive resin material.

10. The lighting device of claim 4, wherein the cover comprises an upper portion corresponding to the lower portion thereof, and a central portion between the lower portion and the upper portion, wherein a diameter of the opening is equal to or less than that of the top surface of the heat sink, and wherein a diameter of the central portion is larger than that of the top surface of the heat sink.

11. The lighting device of claim 4, the cover comprises at least one fluorescent material.

12. The lighting device of claim 4, wherein the cover includes a reflective material reflecting at least a part of the light emitted from the light source, and wherein the reflective material reflects at least the part of the light emitted from the light source toward the heat sink.

13. The lighting device of claim 4, wherein the cover includes a surface being coated with an diffusing agent.

14. The lighting device of claim 4, wherein the bottom surface of the lens unit has a rectangular shape, and wherein the top surface of the substrate has the rectangular shape.

15. The lighting device of claim 4, wherein the lens unit comprises an aspheric lens provided over the light emitting devices.

16. The lighting device of claim 4, wherein the sides is inclined at an angle from 14 degree to 16 degree relative to an axis perpendicular to the top surface of the heat sink.

17. The lighting device of claim 4, wherein the sides comprises a first side and a second side, wherein the light source comprises a first light source disposed on the first side and a second source disposed on the second side, and wherein the first and second light sources are provided at a same height on the first and second sides, respectively.

18. The lighting device of claim 4, wherein the top surface of the heat sink has a circular shape of a prescribed diameter.

19. The lighting device of claim 3, wherein the sides comprises a first side and a second side, which are opposing sides separated from each other, each of the first and second sides having a lower end integrally formed with the top surface of the body and a upper end, and wherein a distance between the upper end of the first sides and the upper end of the second sides is less than a distance between the lower end of the first sides and the lower end of the second sides.

20. A lighting device comprising:

a cover including an opening formed in a lower portion with an empty interior;

a heat sink including a body and a member, the body including a top surface, an outer circumferential surface and a plurality of fins disposed on the outer circumferential surface, the member extended from the top surface toward the cover, the member having a polygonal pillar shape with at least three sides; and a light source disposed on at least one among the sides of the member, the light source including a substrate, a plurality of light emitting devices disposed on the substrate and a lens unit disposed on the light emitting devices, the lens unit covering the light emitting devices, a shape of a bottom surface of the lens unit corresponding to a top surface of the substrate, wherein an entire portion of the plurality of fins are arranged under the top surface of the heat sink, wherein at least a portion of the fin includes a side having an inclination, wherein the inclination has a range more than 45° on the basis of an imaginary line parallel with the top surface of the heat sink, wherein a height of the member is greater than half a height of the cover on the basis of the top surface of the heat sink.

* * * * *